US007945055B2

(12) United States Patent
Taleb et al.

(10) Patent No.: US 7,945,055 B2
(45) Date of Patent: May 17, 2011

(54) FILTER SMOOTHING IN MULTI-CHANNEL AUDIO ENCODING AND/OR DECODING

(75) Inventors: Anisse Taleb, Kista (SE); Stefan Andersson, Trångsund (SE)

(73) Assignee: Telefonaktiebolaget LM Ericcson (publ), Stockholm (SE)

( * ) Notice: Subject to any disclaimer, the term of this patent is extended or adjusted under 35 U.S.C. 154(b) by 1465 days.

(21) Appl. No.: 11/358,720

(22) Filed: Feb. 22, 2006

(65) Prior Publication Data

US 2006/0246868 A1 Nov. 2, 2006

Related U.S. Application Data

(60) Provisional application No. 60/654,956, filed on Feb. 23, 2005.

(30) Foreign Application Priority Data

Dec. 22, 2005 (WO) ..... PCT/SE2005/002033

(51) Int. Cl.
*H04R 5/00* (2006.01)

(52) U.S. Cl. ..... 381/22; 381/23

(58) Field of Classification Search ..... 381/19–23, 381/1, 2; 700/74; 704/500, 501, 503, 504
See application file for complete search history.

(56) References Cited

U.S. PATENT DOCUMENTS 5,285,498 A 2/1994 Johnston
5,394,473 A 2/1995 Davidson
5,434,948 A 7/1995 Holt et al.
5,694,332 A 12/1997 Maturi
5,812,971 A 9/1998 Herre
5,890,125 A * 3/1999 Davis et al. ..... 381/1
5,956,674 A 9/1999 Smyth et al.
6,012,031 A 1/2000 Oliver et al.
6,446,037 B1 9/2002 Fielder et al.
6,487,535 B1 11/2002 Smyth et al.
6,591,241 B1 7/2003 Absar et al.
7,447,629 B2 * 11/2008 Breebaart ..... 381/2
7,725,324 B2 5/2010 Bruhn et al.

(Continued)

FOREIGN PATENT DOCUMENTS

EP 0497413 8/1992

(Continued)

OTHER PUBLICATIONS

U.S. Appl. No. 11/358,726, filed Feb. 22, 2006; Inventor: Taleb.

(Continued)

*Primary Examiner* — Ping Lee
(74) *Attorney, Agent, or Firm* — Nixon & Vanderhye P.C.

(57) ABSTRACT

A first signal representation of one or more of the multiple channels is encoded in a first encoding process, and a second signal representation of one or more of the multiple channels is encoded in a second, filter-based encoding process. Filter smoothing can be used to reduce the effects of coding artifacts. However, conventional filter smoothing generally leads to a rather large performance reduction and is therefore not widely used. It has been recognized that coding artifacts are perceived as more annoying than temporary reduction in stereo width, and that they are especially annoying when the coding filter provides a poor estimate of the target signal; the poorer the estimate, the more disturbing artifacts. Therefore, signal-adaptive filter smoothing is introduced in the second encoding process or a corresponding decoding process.

21 Claims, 10 Drawing Sheets

U.S. PATENT DOCUMENTS

| | | | |
|---|---|---|---|
| 2003/0061055 | A1 | 3/2003 | Taori et al. |
| 2003/0115041 | A1 | 6/2003 | Chen et al. |
| 2003/0115052 | A1 | 6/2003 | Chen et al. |
| 2004/0267543 | A1 | 12/2004 | Ojanpera |
| 2005/0165611 | A1 | 7/2005 | Mehrotra et al. |
| 2006/0004583 | A1 | 1/2006 | Here et al. |

FOREIGN PATENT DOCUMENTS

| | | | |
|---|---|---|---|
| EP | 0965123 | | 1/2003 |
| EP | 1 391 880 | A2 | 2/2004 |
| JP | 11-032399 | | 2/1999 |
| JP | 2001-184090 | | 7/2001 |
| JP | 2001-255899 | | 9/2001 |
| JP | 2002-132295 | | 5/2002 |
| JP | 2003-345398 | | 12/2003 |
| WO | WO 03/090206 | | 10/2003 |
| WO | WO 2005/001813 | A1 | 1/2005 |

OTHER PUBLICATIONS

Office Action mailed Feb. 18, 2009 in co-pending U.S. Appl. No. 11/358,726.

Office Action mailed Jul. 15, 2009 in co-pending U.S. Appl. No. 11/358,726.

Office Action mailed Nov. 23, 2009 in co-pending U.S. Appl. No. 11/358,726.

U.S. Appl. No. 11/011,764, filed Dec. 15, 2004; Inventor: Taleb et al.

C. Faller and F. Baumgarte; "Binaural Cue Coding Applied to Stereo and Multi-Channel Audio Compression;" AES 112$^{th}$ Convention Paper 5574; Munich, Germany; May 10-13, 2002.

B. Edler, C. Faller, and G. Schuller; "Perceptual Audio Coding Using a Time-Varying Linear Pre- and Post-Filter;" AES 109$^{th}$ Convention; Los Angeles; Sep. 22-25, 2000.

B. Bdler and G. Schuller; Audio Coding Using a Psychoacoustic Pre- and Post-Filter; pp. 881-884, 2000.

D. Bauer and D. Seitzer; "Statistical Properties of High Quality Stereo Signals in the Time Domain;" pp. 2045-2048, 1989.

Shyh-Shiaw Kuo and James D. Johnston; "A Study of Why Cross Channel Prediction is Not Applicable to Perceptual Audio Coding;" IEEE Signal Processing Letters, vol. 8, No. 9, Sep. 2001; pp. 245-247.

4.1.2 Symmetry and the LDL$^T$ Factorization; Chapter 4 Special Linear Systems; pp. 137-138.

3GPP Tech. Spec. TS 26.290, V6.1.0, 3$^{rd}$ Generation Partnership Project; Tech. spec. Group Service and System Aspects; Audio Codec Processing Functions; Extended Adaptive Multi-Rate—Wideband (AMR-WB+) Codec; Transcoding Functions (Release 6), Dec. 2004.

International Search Report and Written Opinion mailed Jun. 30, 2006 in corresponding PCT application No. PCT/SE2006/000235.

International Search Report and Written Opinion mailed Mar. 17, 2005 in corresponding PCT Application PCT/SE2004/001867.

Christof Faller and Frank Baumgarte; "Efficient Representation of Spatial Audio Using Perceptual Parametrization;" Applications of Signal Processing to Audio and Acoustics; 2001 IEEE Workshop on Publication date Oct. 21-24, 2001; pp. W2001-1 through W2001-4.

International Search Report and Written Opinion mailed Mar. 17, 2005 in corresponding PCT Application PCT/SE2004/001907.

Summary of the Japanese official action and Japanese official action, dated May 7, 2008 in corresponding Japanese Application No. 2006-518596.

Canadian official action, Jun. 17, 2008, in corresponding Canadian Application No. 2,527,971.

L.R. Rabiner and R.W. Schafer, Chapter 4: "Time-Domain Methods for Speech Processing", Digital Processing of Speech Signals, Upper Saddle River, New Jersey: Prentice Hall, Inc., 1978, pp. 116-130.

European Search Report dated Jun. 29, 2010 in corresponding European Application No. EP 06716925 (5 pages).

Written Opinion of the International Searching Authority for International Application No. PCT/SE2006/000234 dated Jun. 30, 2006.

International Search Report for International Application No. PCT/SE2006/000234 dated Jun. 30, 2006.

Schuller et al., "Perceptual Audio Coding Using a Time-Varying Linear Pre- and Post-Filter", AES 109$^{th}$ Convention, Los Angeles, Sep. 22-25, pp. 1-12 , 2000.

Purnhagen, "Low Complexity Parametric Stereo Coding in MPEG-4", Proc. of the 7$^{th}$ int. Conference on digital Audio Effects (DAFx-04), Naples, IT, Oct. 5-8, 2004.

* cited by examiner

FILTER SMOOTHING IN MULTI-CHANNEL AUDIO ENCODING AND/OR DECODING

This application is the a new U.S. patent application claiming priority to PCT/SE2005/002033 filed 22 Dec. 2005 and U.S. Provisional Application 60/654,956 filed 23 Feb. 2005, the entire contents of each of which are hereby incorporated by reference.

TECHNICAL FIELD

The technical field generally relates to audio encoding and decoding techniques, and more particularly, to multi-channel audio encoding/decoding such as stereo coding/decoding.

BACKGROUND

There is a high market need to transmit and store audio signals at low bit rates while maintaining high audio quality. Particularly, in cases where transmission resources or storage is limited low bit rate operation is an essential cost factor. This is typically the case, for example, in streaming and messaging applications in mobile communication systems such as GSM, UMTS, or CDMA.

A general example of an audio transmission system using multi-channel coding and decoding is schematically illustrated in FIG. 1. The overall system basically comprises a multi-channel audio encoder 100 and a transmission module 10 on the transmitting side, and a receiving module 20 and a multi-channel audio decoder 200 on the receiving side.

The simplest way of stereophonic or multi-channel coding of audio signals is to encode the signals of the different channels separately as individual and independent signals, as illustrated in FIG. 2. However, this means that the redundancy among the plurality of channels is not removed, and that the bit-rate requirement will be proportional to the number of channels.

Another basic way used in stereo FM radio transmission and which ensures compatibility with legacy mono radio receivers is to transmit a sum and a difference signal of the two involved channels.

State-of-the art audio codecs such as MPEG-1/2 Layer III and MPEG-2/4 AAC make use of so-called joint stereo coding. According to this technique, the signals of the different channels are processed jointly rather than separately and individually. The two most commonly used joint stereo coding techniques are known as 'Mid/Side' (M/S) Stereo and intensity stereo coding which usually are applied on sub-bands of the stereo or multi-channel signals to be encoded.

M/S stereo coding is similar to the described procedure in stereo FM radio, in a sense that it encodes and transmits the sum and difference signals of the channel sub-bands and thereby exploits redundancy between the channel sub-bands. The structure and operation of a coder based on M/S stereo coding is described, e.g. in reference [1].

Intensity stereo on the other hand is able to make use of stereo irrelevancy. It transmits the joint intensity of the channels (of the different sub-bands) along with some location information indicating how the intensity is distributed among the channels. Intensity stereo does only provide spectral magnitude information of the channels, while phase information is not conveyed. For this reason and since temporal inter-channel information (more specifically the inter-channel time difference) is of major psycho-acoustical relevancy particularly at lower frequencies, intensity stereo can only be used at high frequencies above e.g. 2 kHz. An intensity stereo coding method is described, e.g. in reference [2].

A recently developed stereo coding method called Binaural Cue Coding (BCC) is described in reference [3]. This method is a parametric multi-channel audio coding method. The basic principle of this kind of parametric coding technique is that at the encoding side the input signals from N channels are combined to one mono signal. The mono signal is audio encoded using any conventional monophonic audio codec. In parallel, parameters are derived from the channel signals, which describe the multi-channel image. The parameters are encoded and transmitted to the decoder, along with the audio bit stream. The decoder first decodes the mono signal and then regenerates the channel signals based on the parametric description of the multi-channel image.

The principle of the Binaural Cue Coding (BCC) method is that it transmits the encoded mono signal and so-called BCC parameters. The BCC parameters comprise coded inter-channel level differences and inter-channel time differences for sub-bands of the original multi-channel input signal. The decoder regenerates the different channel signals by applying sub-band-wise level and phase and/or delay adjustments of the mono signal based on the BCC parameters. The advantage over e.g. M/S or intensity stereo is that stereo information comprising temporal inter-channel information is transmitted at much lower bit rates. However, BCC is computationally demanding and generally not perceptually optimized.

Another technique, described in reference [4] uses the same principle of encoding of the mono signal and so-called side information. In this case, the side information consists of predictor filters and optionally a residual signal. The predictor filters, estimated by an LMS algorithm, when applied to the mono signal allow the prediction of the multi-channel audio signals. With this technique one is able to reach very low bit rate encoding of multi-channel audio sources, however at the expense of a quality drop.

The basic principles of such parametric stereo coding are illustrated in FIG. 3, which displays a layout of a stereo codec, comprising a down-mixing module 120, a core mono codec 130, 230 and a parametric stereo side information encoder/decoder 140, 240. The down-mixing transforms the multi-channel (in this case stereo) signal into a mono signal. The objective of the parametric stereo codec is to reproduce a stereo signal at the decoder given the reconstructed mono signal and additional stereo parameters.

For completeness, a technique is to be mentioned that is used in 3D audio. This technique synthesizes the right and left channel signals by filtering sound source signals with so-called head-related filters. However, this technique requires the different sound source signals to be separated and can thus not generally be applied for stereo or multi-channel coding.

Rapid changes in the filter characteristics between consecutive frames create disturbing aliasing artifacts and instability in the reconstructed stereo image. To overcome this problem, filter smoothing has been introduced. However, conventional filter smoothing generally leads to a rather large performance reduction since the filter coefficients no longer are optimal for the present frame. In particular, traditional filter smoothing generally leads to an overall reduction of the stereo image width.

Thus there is a general need for improved filter smoothing in multi-channel encoding and/or decoding processes.

SUMMARY

The technology described herein overcomes these and other drawbacks of the prior art arrangements.

It is a general object to provide high multi-channel audio quality at low bit rates.

It is an object to provide improved filter smoothing in multi-channel audio encoding and/or decoding.

In particular it is desirable to provide an efficient encoding and/or decoding process that is capable of removing or at least reducing the effects of coding artifacts in an efficient manner.

It is also desirable to be capable of handling the problem of stereo image width reduction.

It is a particular object to provide a method and apparatus for encoding a multi-channel audio signal.

Another particular object is to provide a method and apparatus for decoding an encoded multi-channel audio signal.

Yet another particular object is to provide an improved audio transmission system.

The technology described herein relies on the principle of encoding a first signal representation of one or more of the multiple channels in a first encoding process, and encoding a second signal representation of one or more of the multiple channels in a second, filter-based encoding process.

Coding artifacts introduced by filter-based encoding such as parametric coding are perceived as much more annoying than temporary reduction of multi-channel or stereo width. In particular, tests have revealed that the artifacts are especially annoying when the coding filter provides a poor estimate of the target signal; the poorer estimate, the more disturbing effect.

Signal-adaptive filter smoothing is therefore performed in the second, filter-based encoding process or in the corresponding decoding process.

Preferably, the signal-adaptive filter smoothing is based on the procedure of estimating expected performance of the first encoding process and/or the second encoding process, and dynamically adapting the filter smoothing in dependence on the estimated performance. In this way, it is possible to more flexibly control the filter smoothing so that it is performed only when really needed. Consequently, unnecessary reduction of the signal energy, for example when the expected coding performance is sufficient, can be avoided completely. For stereo coding, for example, this means that problem of stereo image width reduction due to filter smoothing can be handled in an efficient manner, while still effectively eliminating coding artifacts and stabilizing the stereo image.

By making the filter smoothing dependent on characteristics of the multi-channel audio input signal, such as inter-channel correlation characteristics, it is possible to first estimate the expected performance of the encoding process(es) and then adjust the degree and/or type of smoothing accordingly.

For example, the first encoding process may be a main encoding process and the first signal representation may be a main signal representation. The second encoding process may for example be an auxiliary/side signal process, and the second signal representation may then be a side signal representation such as a stereo side signal.

In a preferred example embodiment, the performance of a filter of the second encoding process is estimated based on characteristics of the multi-channel audio signal, and the filter smoothing is then preferably adapted in dependence on the estimated filter performance of the second encoding process. Preferably, the filter smoothing is performed by modifying the filter in dependence on the estimated filter performance. This normally involves reducing the energy of the filter. Advantageously, an adaptive smoothing factor is determined in dependence on the estimated filter performance, and the filter is modified by means of the adaptive smoothing factor.

When the second encoding process is an auxiliary/side encoding process it is normally based on parametric coding such as adaptive inter-channel prediction (ICP). In this case, the filter smoothing may be based on estimated expected performance of the second encoding process in general, and based on the ICP filter performance in particular. The ICP filter performance is typically representative of the prediction gain of the inter-channel prediction.

Equivalently, the signal-adaptive filter smoothing can be performed on the decoding side. The decoding side is responsive to information representative of signal-adaptive filter smoothing from the encoding side, and performs signal-adaptive filter smoothing in a corresponding second decoding process based on this information. Preferably, the signal-adaptive information comprises a smoothing factor that depends on estimated performance of an encoding process on the encoding side.

The technology described herein offers the following advantages:

Improved multi-channel audio encoding/decoding.
Improved audio transmission system.
High multi-channel audio quality.
Flexible and highly efficient filter smoothing.
Reduced effect of coding artifacts.
Stabilized multi-channel or stereo image.

DETAILED DESCRIPTION

Figure 1:
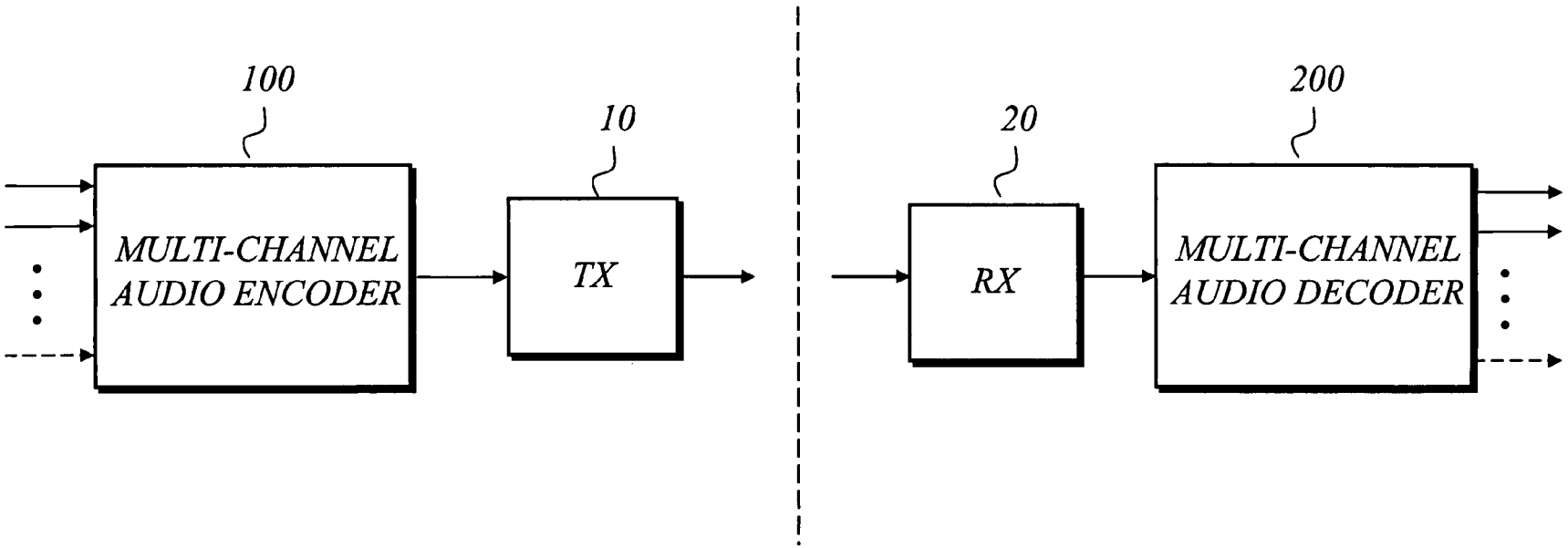
Fig. 1 (Prior art)
FIG. 1 is a schematic block diagram illustrating a general example of an audio transmission system using multi-channel coding and decoding.
Figure 2:
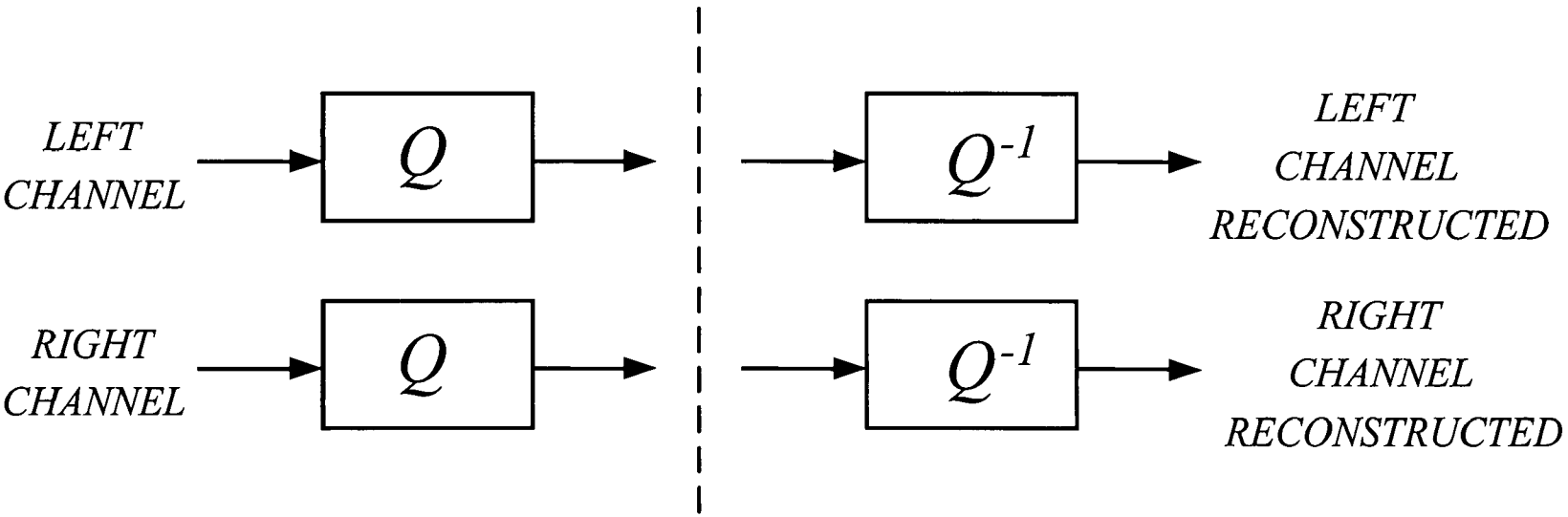
Fig. 2 (Prior art)
FIG. 2 is a schematic diagram illustrating how signals of different channels are encoded separately as individual and independent signals.
Figure 3:
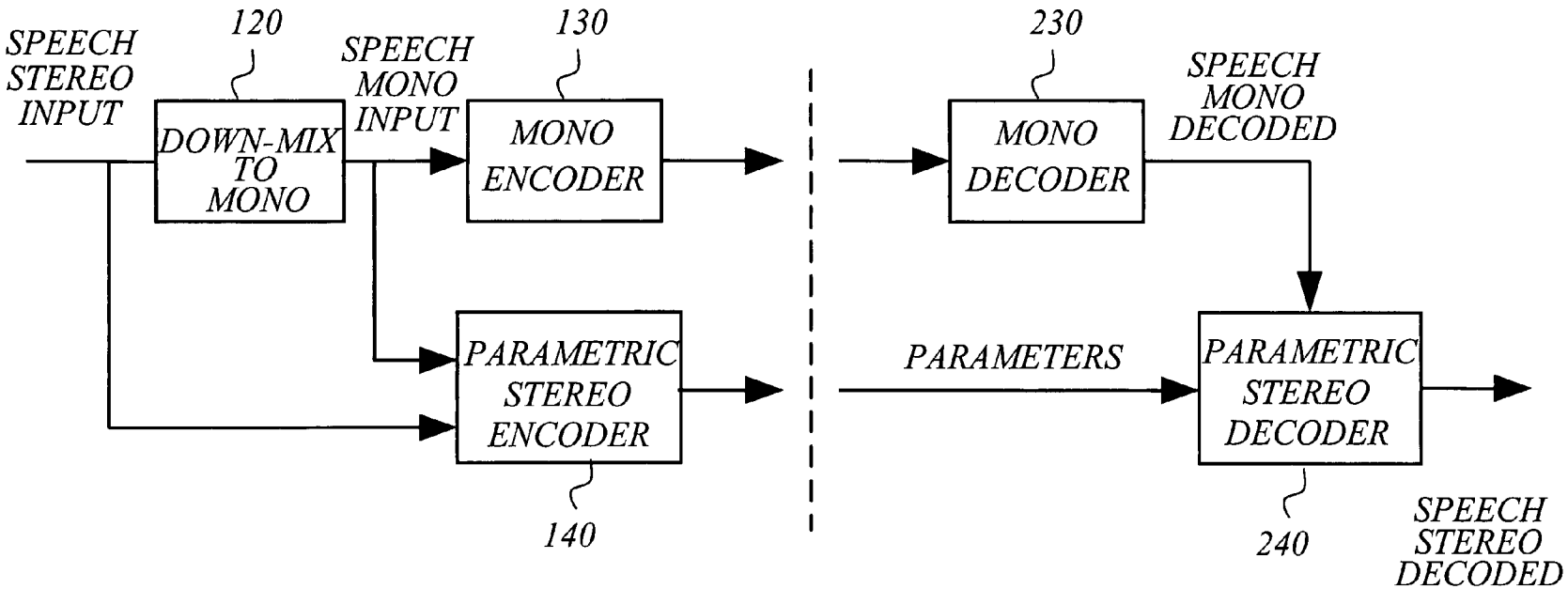
Fig. 3 (Prior art)
FIG. 3 is a schematic block diagram illustrating the basic principles of parametric stereo coding.

Throughout the drawings, the same reference characters will be used for corresponding or similar elements.

The technology described herein relates to multi-channel encoding/decoding techniques in audio applications, and particularly to stereo encoding/decoding in audio transmission systems and/or for audio storage. Examples of possible audio applications include phone conference systems, stereophonic audio transmission in mobile communication systems, various systems for supplying audio services, and multi-channel home cinema systems.

It may be useful to begin with a brief overview and analysis of problems with existing technology. Today, there are no standardized codecs available providing high stereophonic or multi-channel audio quality at bit rates which are economically interesting for use in e.g. mobile communication systems, as mentioned previously. What is possible with available codecs is monophonic transmission and/or storage of the audio signals. To some extent also stereophonic transmission or storage is available, but bit rate limitations usually require limiting the stereo representation quite drastically.

The problem with the state-of-the-art multi-channel coding techniques is that they require high bit rates in order to provide good quality. Intensity stereo, if applied at low bit rates as low as e.g. only a few kbps suffers from the fact that it does not provide any temporal inter-channel information. As this information is perceptually important for low frequencies below e.g. 2 kHz, it is unable to provide a stereo impression at such low frequencies.

BCC on the other hand is able to reproduce the stereo or multi-channel image even at low frequencies at low bit rates of e.g. 3 kbps since it also transmits temporal inter-channel information. However, this technique requires computationally demanding time-frequency transforms on each of the channels both at the encoder and the decoder. Moreover, BCC does not attempt to find a mapping from the transmitted mono signal to the channel signals in a sense that their perceptual differences to the original channel signals are minimized.

The LMS technique, also referred to as inter-channel prediction (ICP), for multi-channel encoding, see [4], allows lower bit rates by omitting the transmission of the residual signal. To derive the channel reconstruction filter, an unconstrained error minimization procedure calculates the filter such that its output signal matches best the target signal. In order to compute the filter, several error measures may be used. The mean square error or the weighted mean square error are well known and are computationally cheap to implement.

One could say that in general, most of the state-of-the-art methods have been developed for coding of high-fidelity audio signals or pure speech. In speech coding, where the signal energy is concentrated in the lower frequency regions, sub-band coding is rarely used. Although methods as BCC allow for low bit-rate stereo speech, the sub-band transform coding processing increases both complexity and delay.

Research concludes that even though ICP coding techniques do not provide good results for high-quality stereo signals, for stereo signals with energy concentrated in the lower frequencies, redundancy reduction is possible [5]. The whitening effects of the ICP filtering increase the energy in the upper frequency regions, resulting in a net coding loss for perceptual transform coders. These results have been confirmed in [6] and [7] where quality enhancements have been reported only for speech signals.

Figure 4:
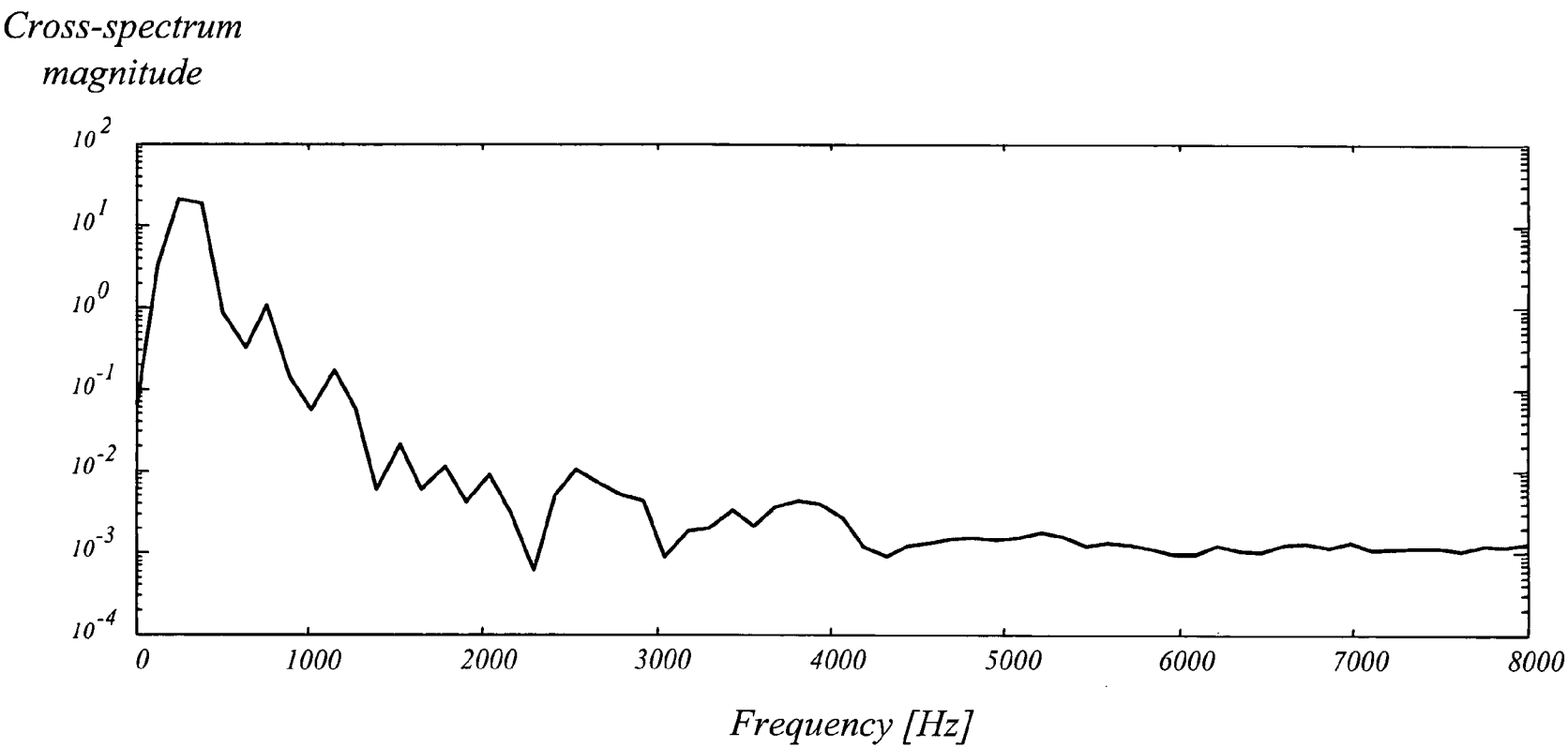
FIG. 4 is a diagram illustrating the cross spectrum of mono and side signals.

The accuracy of the ICP reconstructed signal is governed by the present inter-channel correlations. Bauer et al. [8] did not find any linear relationship between left and right channels in audio signals. However, as can be seen from the cross spectrum of the mono and side signals in FIG. 4, strong inter-channel correlation is found in the lower frequency regions (0-2000 Hz) for speech signals. In the event of low inter-channel correlations, the ICP filter, as means for stereo coding, will produce a poor estimate of the target signal.

Rapid changes in the ICP filter characteristics between consecutive frames create disturbing aliasing artifacts and instability in the reconstructed stereo image. This comes from the fact that the predictive approach introduces large spectral variations as opposed to a fixed filtering scheme.

Similar effects are also present in BCC when spectral components of neighboring sub-bands are modified differently [10]. To circumvent this problem, BCC uses overlapping windows in both analysis and synthesis.

The use of overlappning windows solves the alising problem for ICP filtering as well. However, this comes at the expense of a rather large performance reduction since the filter coefficients will normally be far from optimal for the present frame when overlapping frames are used.

In conclusion, conventional filter smoothing generally leads to a rather large performance reduction and is therefore not widely used.

Listening tests have revealed that coding artifacts introduced by ICP filtering are perceived as more annoying than temporary reduction in stereo width. It has been recognized that the artifacts are especially annoying when the coding filter provides a poor estimate of the target signal; the poorer the estimate, the more disturbing artifacts. Therefore, a basic idea according to the invention is to introduce signal-adaptive filter smoothing as a new general concept for solving the problems of the prior art.

Figure 5:
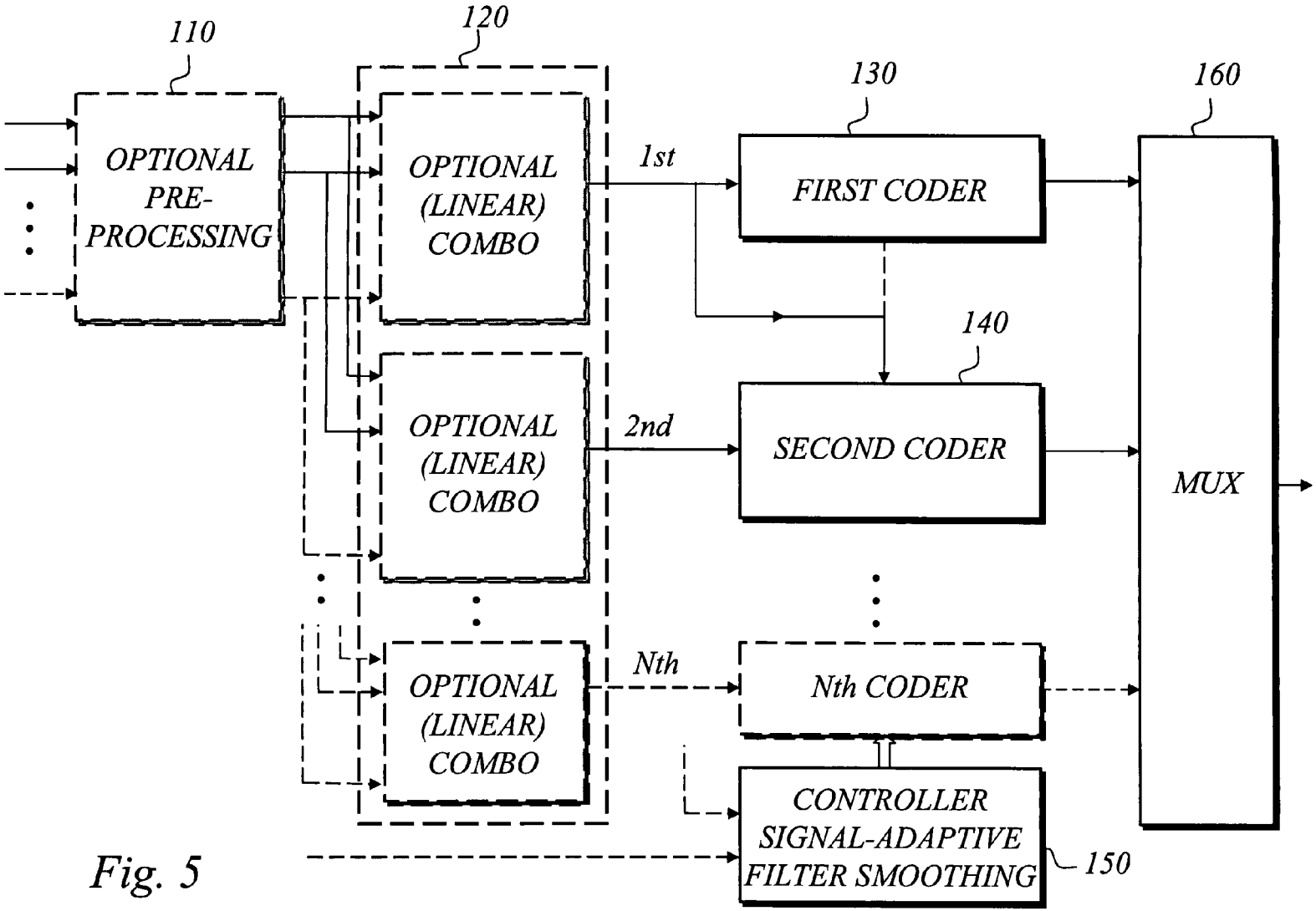
FIG. 5 is a schematic block diagram of a multi-channel encoder according to an example preferred embodiment.

FIG. 5 is a schematic block diagram of a multi-channel encoder according to an example preferred embodiment. The multi-channel encoder basically comprises an optional pre-processing unit 110, an optional (linear) combination unit 120, a number of encoders 130, 140, a controller 150 and an optional multiplexor (MUX) unit 160. The number N of encoders is equal to or greater than 2, and includes a first encoder 130 and a second encoder 140, and possibly further encoders.

In general, a multi-channel or polyphonic signal is considered. The initial multi-channel input signal can be provided from an audio signal storage (not shown) or "live", e.g. from a set of microphones (not shown). The audio signals are normally digitized, if not already in digital form, before entering the multi-channel encoder. The multi-channel signal may be provided to the optional pre-processing unit 110 as well as an optional signal combination unit 120 for generating a number N of signal representations, such as for example a main signal representation and an auxiliary signal representation, and possibly further signal representations.

The multi-channel or polyphonic signal may be provided to the optional pre-processing unit 110, where different signal conditioning procedures may be performed.

The (optionally pre-processed) signals may be provided to an optional signal combination unit 120, which includes a number of combination modules for performing different signal combination procedures, such as linear combinations of the input signals to produce at least a first signal and a second signal. For example, the first encoding process may be a main encoding process and the first signal representation may be a main signal representation. The second encoding process may for example be an auxiliary (side) signal process, and the second signal representation may then be an auxiliary (side) signal representation such as a stereo side signal. In traditional stereo coding, for example, the L and R channels are summed, and the sum signal is divided by a factor of two in order to provide a traditional mono signal as the first (main) signal. The L and R channels may also be subtracted, and the difference signal is divided by a factor of two to provide a traditional side signal as the second signal. According to the invention, any type of linear combination, or any other type of signal combination for that matter, may be performed in the signal combination unit with weighted contributions from at least part of the various channels. As understood, the signal combination used by the invention is not limited to two channels but may of course involve multiple channels. It is also possible to generate more than two signals, as indicated in FIG. 5. It is even possible to use one of the input channels directly as a first signal, and another one of the input channels directly as a second signal. For stereo coding, for example, this means that the L channel may be used as main signal and the R channel may be used as side signal, or vice versa. A multitude of other variations also exist.

A first signal representation is provided to the first encoder 130, which encodes the first signal according to any suitable encoding principle. A second signal representation is provided to the second encoder 140 for encoding the second signal. If more than two encoders are used, each additional signal representation is normally encoded in a respective encoder.

By way of example, the first encoder may be a main encoder, and the second encoder may be a side encoder. In such a case, the second side encoder 140 may for example include an adaptive inter-channel prediction (ICP) stage for generating signal reconstruction data based on the first signal representation and the second signal representation. The first (main) signal representation may equivalently be deduced from the signal encoding parameters generated by the first encoder 130, as indicated by the dashed line from the first encoder.

The overall multi-channel encoder also comprises a controller 150, which is configured to control a filter smoothing procedure in the second encoder 140 and/or in any of the additional encoders in a signal-adaptive manner in response to characteristics of the multi-channel audio signal. By making the filter smoothing dependent on characteristics of the multi-channel audio signal, such as inter-channel correlation characteristics, it is for example possible to let the controller 150 estimate the expected performance of the encoding process(es) based on the multi-channel audio signal and then adjust the degree and/or type of smoothing accordingly. This will provide a more flexible control so that filter smoothing is performed only when really needed. The better performance, the lesser degree of smoothing is required. The other way around, the worse expected performance of the encoding process, the more smoothing should be applied.

The control system, which may be realized as a separate controller 150 or integrated in the considered encoder, gives the appropriate control commands to the encoder.

The output signals of the various encoders are preferably multiplexed into a single transmission (or storage) signal in the multiplexer unit 160. However, alternatively, the output signals may be transmitted (or stored) separately.

In general, encoding is typically performed on a frame-by-frame basis, one frame at a time, and each frame normally comprises audio samples within a pre-defined time period.

Figure 6:
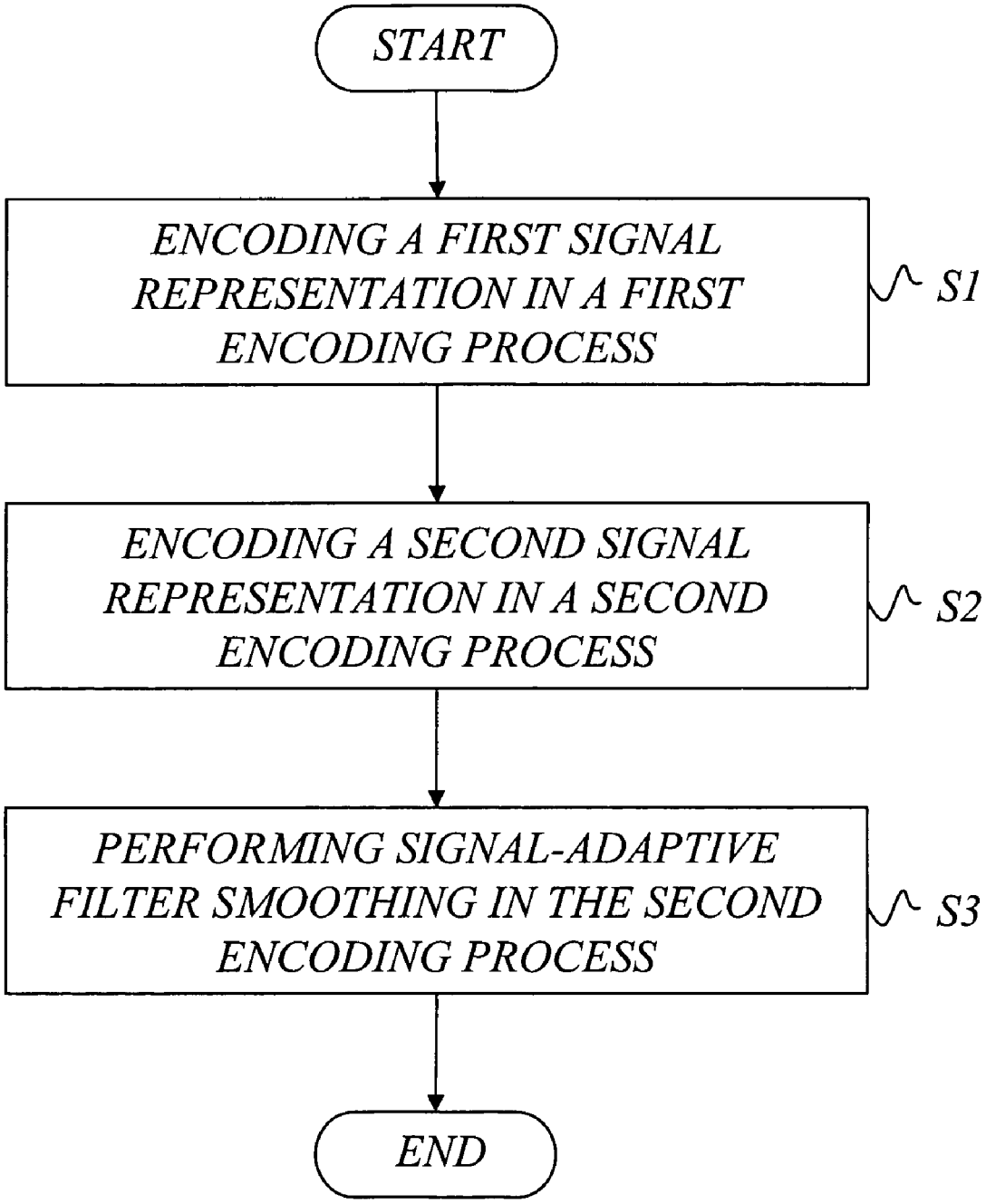
FIG. 6 is a schematic flow diagram setting forth a basic multi-channel encoding procedure according to a preferred example embodiment.

FIG. 6 is a schematic flow diagram setting forth a basic multi-channel encoding procedure according to a preferred embodiment. In step S1, a first signal representation of one or more audio channels is encoded in a first encoding process. In step S2, a second signal representation of one or more audio channels is encoded in a second encoding process. In step S3, filter smoothing is performed in the second encoding process or a corresponding decoding process in a signal-adaptive manner, in response to characteristics of the multi-channel audio signal.

Figure 7:
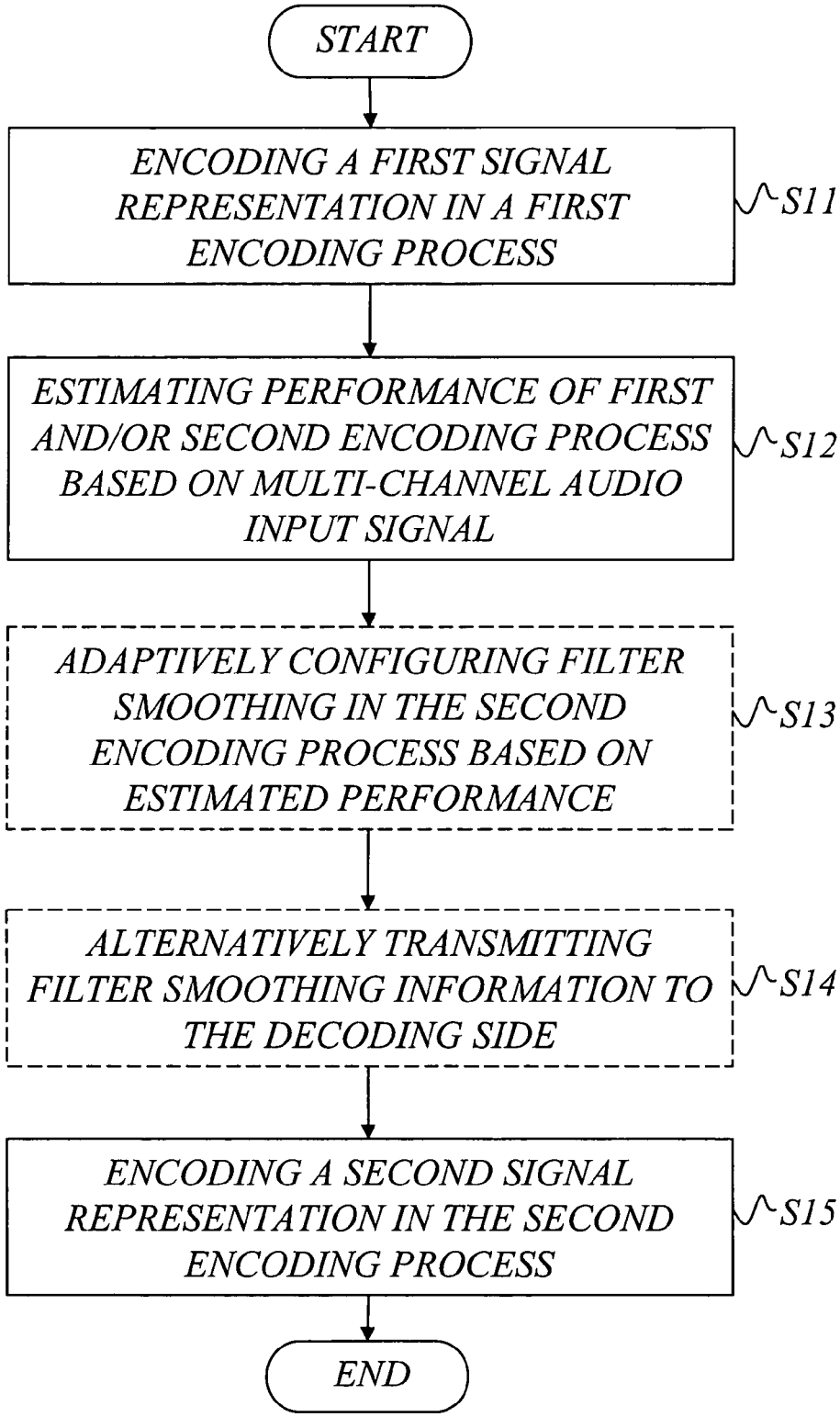
FIG. 7 is a more detailed schematic flow diagram illustrating an exemplary encoding procedure according to a preferred example embodiment.

FIG. 7 is a more detailed schematic flow diagram illustrating an exemplary encoding procedure according to a preferred embodiment. In step S11, the first signal representation is encoded in the first encoding process. In step S12, expected performance of the first encoding process and/or the second encoding process is estimated based on the multi-channel audio input signal. In step S13, the filter smoothing in the second encoding process is dynamically configured based on the estimated performance. Alternatively, filter smoothing information may be transmitted to the decoding side, in step S14, as will be explained below. Finally, in step S15, the second signal representation is encoded in the second encoding process, preferably based on the adaptively configured filter smoothing (unless the filter smoothing should be performed on the decoding side).

By dynamically adapting the filter smoothing in dependence on the estimated performance, it is possible to more flexibly control the filter smoothing. Consequently, unnecessary reduction of the signal energy, for example when the expected coding performance is sufficient, can be avoided completely.

The overall decoding process is generally quite straight forward and basically involves reading the incoming data stream, (possibly interpreting data using transmitted control information), inverse quantization and final reconstruction of the multi-channel audio signal. More specifically, in response to first signal reconstruction data, an encoded first signal representation of at least one of said multiple channels is decoded in a first decoding process. In response to second signal reconstruction data, an encoded second signal representation of at least one of said multiple channels is decoded in a second decoding process. If filter smoothing should be performed on the decoding side instead of on the encoding side, information representative of signal-adaptive filter smoothing will have to be transmitted from the encoding side (S14 in FIG. 7). This enables the decoder to perform signal-adaptive filter smoothing in a corresponding second decoding process based on this information.

For a more detailed understanding, the technology will now mainly be described with reference to exemplary embodiments of stereophonic (two-channel) encoding and decoding. However, it should be kept in mind that the technology is generally applicable to multiple channels. Examples include but are not limited to encoding/decoding 5.1 (front left, front centre, front right, rear left and rear right and subwoofer) or 2.1 (left, right and center subwoofer) multi-channel sound.

Figure 8:
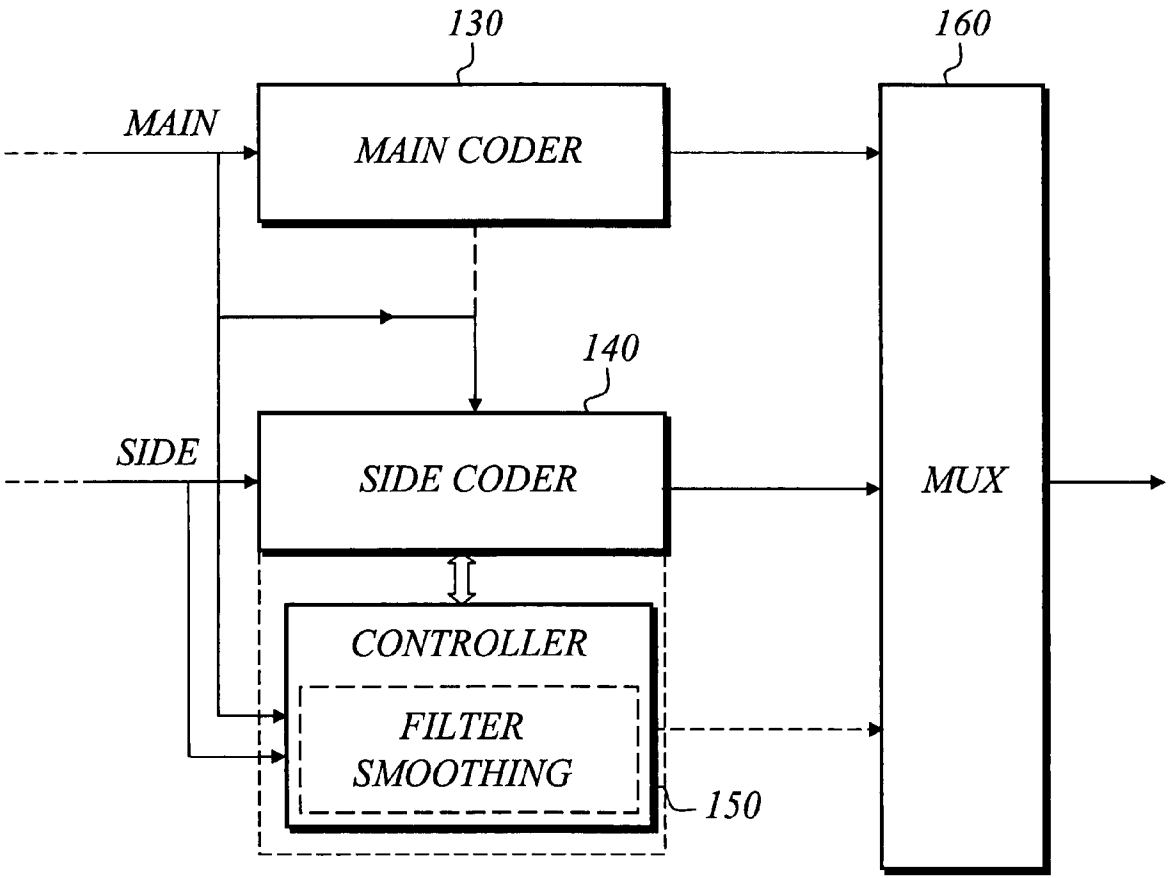
FIG. 8 is a schematic block diagram illustrating relevant parts of an encoder according to an exemplary preferred example embodiment.

FIG. 8 is a schematic block diagram illustrating relevant parts of an encoder according to an example preferred embodiment. The encoder basically comprises a first (main) encoder 130 for encoding a first (main) signal such as a typical mono signal, a second (auxiliary/side) encoder 140 for (auxiliary/side) signal encoding, a controller 150 and an optional multiplexor unit 160. The controller 150 is adapted to receive the main signal representation and the side signal representation (or any other appropriate representations of the multi-channel audio signal) and configured to perform the necessary computations to provide adaptive control of the filter smoothing within the side encoder 140.

The controller 150 may be a "separate" controller or integrated into the side encoder 140. The encoding parameters are preferably multiplexed into a single transmission or storage signal in the multiplexor unit 160. If filter smoothing is to be performed on the decoding side, the controller generates the appropriate smoothing information and the information is preferably sent to the decoding side via the multiplexor.

Figure 9:
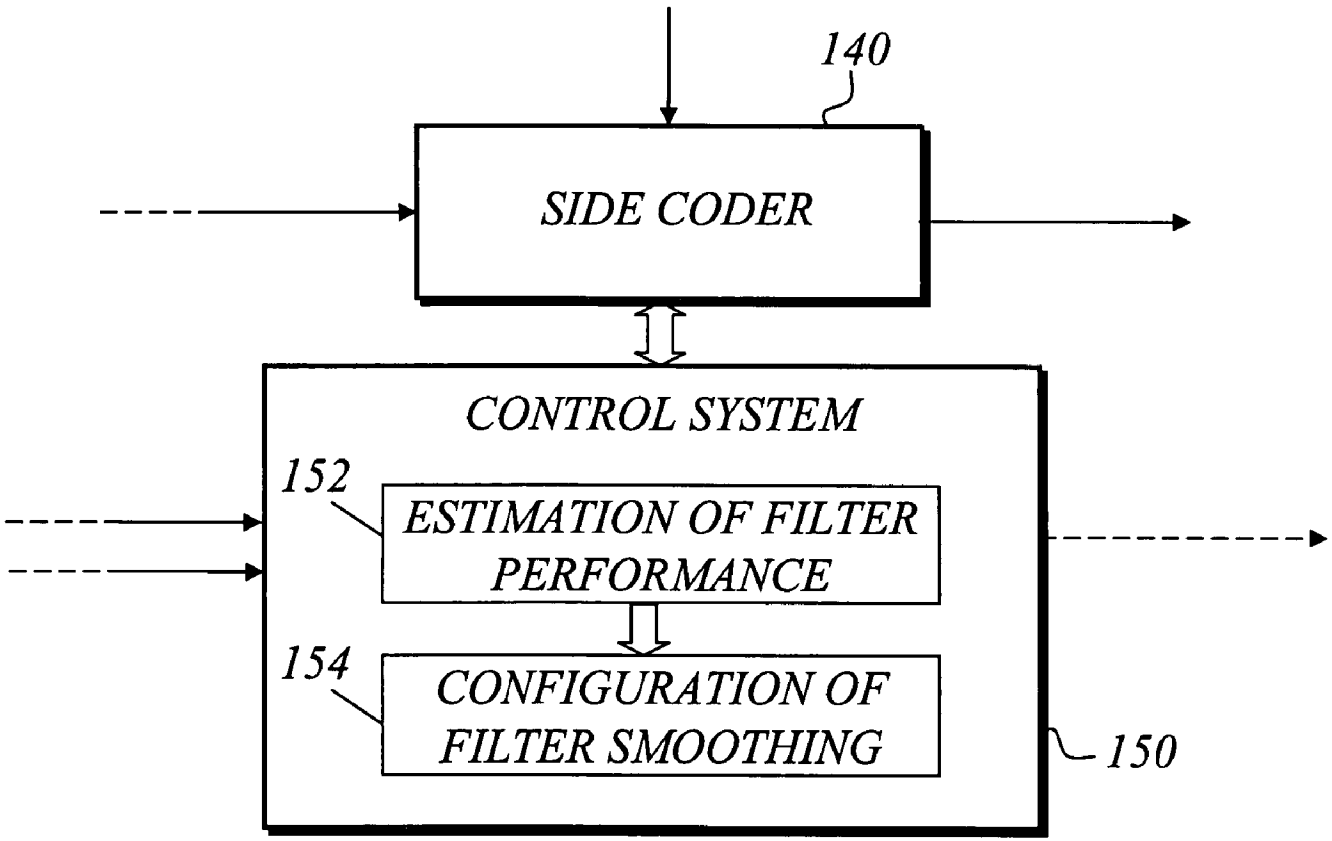
FIG. 9 is a schematic block diagram illustrating relevant parts of a side encoder and an associated control system according to an example embodiment.

FIG. 9 is a schematic block diagram illustrating relevant parts of a side encoder and an associated control system according to an example embodiment. The control system 150 includes a module for estimation of filter performance 152 and a module for filter smoothing configuration. The module 152 for estimation of filter performance preferably operates based on a main signal representation and a side signal representation of the multi-channel audio signal, and estimates the expected performance of a filter in the side encoder 140. The filter may for example be a parametric filter, such as an ICP filter, or any other suitable conventional filter known to the art. For an ICP filter, the performance may be calculated based on a prediction error. This may equivalently be expressed as a prediction gain. The module 154 for filter smoothing configuration makes the necessary adaptation of the filter smoothing settings in response to the estimated filter performance, and controls the filter smoothing in the side encoder accordingly.

Figure 10:
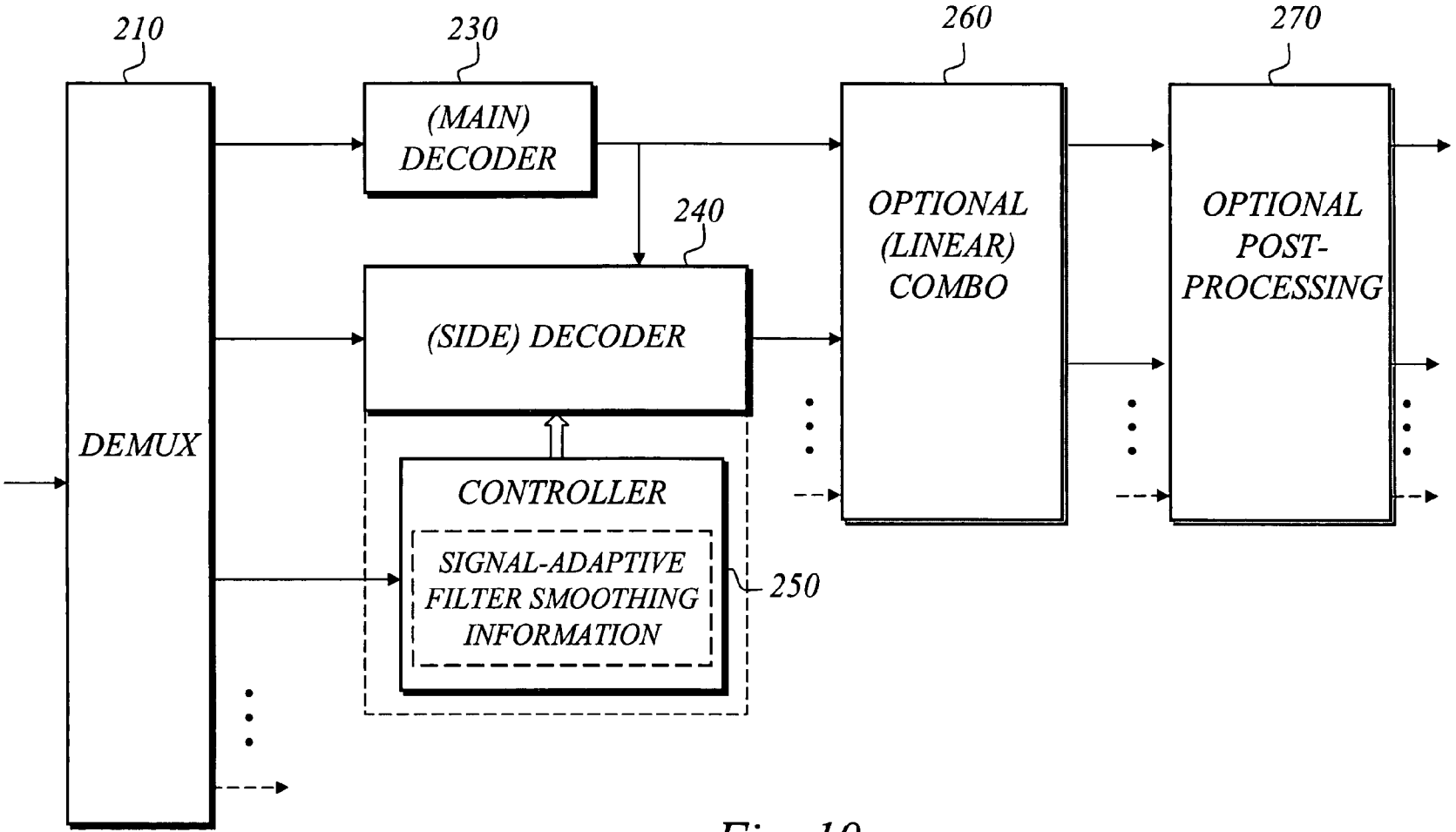
FIG. 10 illustrates relevant parts of a decoder according to preferred example embodiment.

FIG. 10 is a schematic block diagram illustrating relevant parts of a decoder according to an example preferred embodiment. The decoder basically comprises an optional demultiplexor unit 210, a first (main) decoder 230, a second (auxiliary/side) decoder 240, a controller 250, an optional signal combination unit 260 and an optional post-processing unit 270. The demultiplexor 210 preferably separates the incoming reconstruction information such as first (main) signal reconstruction data, second (auxiliary/side) signal reconstruction data and control information such as information on frame division configuration and filter lengths. The first (main) decoder 230 "reconstructs" the first (main) signal in response to the first (main) signal reconstruction data, usually provided in the form of first (main) signal representing encoding parameters. The second (auxiliary/side) decoder 240 preferably "reconstructs" the second (side) signal in response to quantized filter coefficients and the reconstructed first signal representation. The second (side) decoder 240 is also controlled by the controller 250, which may or may not be integrated into the side decoder. In this example, the controller 250 receives smoothing information such as a smoothing factor from the encoding side, and controls the side decoder 240 accordingly.

More detailed examples are based on parametric coding principles such as inter-channel prediction.

Parametric Coding Using Inter-channel Prediction

In general, inter-channel prediction (ICP) techniques utilize the inherent inter-channel correlation between the channels. In stereo coding, channels are usually represented by the left and the right signals l(n), r(n), an equivalent representation is the mono signal m(n) (a special case of the main signal) and the side signal s(n). Both representations are equivalent and are normally related by the traditional matrix operation:

$$\begin{bmatrix} m(n) \\ s(n) \end{bmatrix} = \frac{1}{2}\begin{bmatrix} 1 & 1 \\ 1 & -1 \end{bmatrix}\begin{bmatrix} l(n) \\ r(n) \end{bmatrix} \tag{1}$$

The ICP technique aims to represent the side signal s(n) by an estimate $\hat{s}(n)$, which is obtained by filtering the mono signal m(n) through a time-varying FIR filter H(z) having N filter coefficients $h_t(i)$:

$$\hat{s}(n) = \sum_{i=0}^{N-1} h_t(i)m(n-i) \tag{2}$$

It should be noted that the same approach could be applied directly on the left and right channels.

The ICP filter derived at the encoder may for example be estimated by minimizing the mean squared error (MSE), or a related performance measure, for instance psycho-acoustically weighted mean square error, of the side signal prediction error e(n). The MSE is typically given by:

$$\xi(h) = \sum_{n=0}^{L-1} MSE(n, h) = \sum_{n=0}^{L-1}\left(s(n) - \sum_{i=0}^{N-1} h(i)m(n-i)\right)^2 \tag{3}$$

where L is the frame size and N is the length/order/dimension of the ICP filter. Simply speaking, the performance of the ICP filter, thus the magnitude of the MSE, is the main factor determining the final stereo separation. Since the side signal describes the differences between the left and right channels, accurate side signal reconstruction is essential to ensure a wide enough stereo image.

The optimal filter coefficients are found by minimizing the MSE of the prediction error over all samples and are given by:

$$h_{opt}{}^T R = r \Rightarrow h_{opt} = R^{-1} r \tag{4}$$

In (4) the correlations vector r and the covariance matrix R are defined as:

$$\begin{aligned} r &= Ms \\ R &= MM^T \\ &\text{where} \\ s &= [s(0)\ \ s(1)\ \ \cdots\ \ s(L-1)]^T, \end{aligned} \tag{5}$$

$$M = \begin{bmatrix} m(0) & m(1) & \cdots & m(L-1) \\ m(-1) & m(0) & \cdots & m(L-2) \\ \vdots & \ddots & \ddots & \vdots \\ m(-N+1) & \cdots & \cdots & m(L-N) \end{bmatrix} \tag{6}$$

Inserting (5) into (3) one gets a simplified algebraic expression for the Minimum MSE (MMSE) of the (unquantized) ICP filter:

$$MMSE = MSE(h_{opt}) = P_{SS} - r^T R^{-1} r \tag{7}$$

where $P_{SS}$ is the power of the side signal, also expressed as $s^T s$.

Inserting $r = Rh_{opt}$ into (7) yields:

$$MMSE = P_{SS} - r^T R^{-1} R h_{opt} = P_{SS} - r^T h_{opt} \tag{8}$$

LDLT factorization [9] on R gives us the equation system:

$$L\underbrace{DL^T h}_{z} = r \tag{9}$$

Where we first solve z in and iterative fashion:

$$\begin{bmatrix} 1 & 0 & \cdots & 0 \\ l_{21} & 1 & \ddots & \vdots \\ \vdots & \ddots & \ddots & 0 \\ l_{N1} & \cdots & l_{NN-1} & 1 \end{bmatrix}\begin{bmatrix} z_1 \\ z_2 \\ \vdots \\ z_N \end{bmatrix} = \begin{bmatrix} r_1 \\ r_2 \\ \vdots \\ r_N \end{bmatrix} \Rightarrow z_i = r_i - \sum_{j=1}^{i-1} l_{ij} z_j \tag{10}$$

Now we introduce a new vector $q = L^T h$. Since the matrix D only has non-zero values in the diagonal, finding q is straightforward:

$$Dq = z \Rightarrow q_i = \frac{z_i}{d_i},\ i = 1, 2, \ldots, N \tag{11}$$

The sought filter vector h can now be calculated iteratively in the same way as (10):

$$\begin{bmatrix} 1 & l_{12} & \cdots & l_{1N} \\ 0 & 1 & \ddots & \vdots \\ \vdots & \ddots & \ddots & l_{N-1N} \\ 0 & \cdots & 0 & 1 \end{bmatrix}\begin{bmatrix} h_1 \\ h_2 \\ \vdots \\ h_N \end{bmatrix} = \begin{bmatrix} q_1 \\ q_2 \\ \vdots \\ q_N \end{bmatrix} \Rightarrow h_i = q_i - \sum_{j=1}^{N-i} l_{i(i+j)} h_{(i+j)}, \quad i = 1, 2, \ldots, N \tag{12}$$

Besides the computational savings compared to regular matrix inversion, this solution offers the possibility of efficiently calculating the filter coefficients corresponding to different dimensions n (filter lengths):

$$H = \{h_{opt}^{(n)}\}_{n=1}^{N} \tag{13}$$

The optimal ICP (FIR) filter coefficients $h_{opt}$ may be estimated, quantized and sent to the decoder on a frame-by-frame basis.

In general, the filter coefficients are treated as vectors, which are efficiently quantized using vector quantization (VQ). The quantization of the filter coefficients is one of the most important aspects of the ICP coding procedure. As will be seen, the quantization noise introduced on the filter coefficients can be directly related to the loss in MSE.

The MMSE has previously been defined as:

$$MMSE = s^T s - r^T h_{opt} = s^T s - 2h_{opt}^T r + h_{opt}^T R h_{opt} \tag{14}$$

Quantizing $h_{opt}$ introduces a quantization error e: $\hat{h} = h_{opt} + e$. The new MSE can now be written as:

$$\begin{aligned} MSE(h_{opt} + e) &= s^T s - 2(h_{opt} + e)^T r + (h_{opt} + e)^T R(h_{opt} + e) \\ &= MMSE + e^T R h_{opt} + e^T R e + h_{opt}^T R e - 2e^T r \\ &= MMSE + e^T R e + 2e^T R h_{opt} - 2e^T r \end{aligned} \tag{15}$$

Since $Rh_{opt} = r$, the last two terms in (15) cancel out and the MSE of the quantized filter becomes:

$$MSE(\hat{h}) = s^T s - r^T h_{opt} + e^T R e \tag{16}$$

What this means is that in order to have any prediction gain at all the quantization error term has to be lower than the prediction term, i.e. $r^T h_{opt} > e^T R e$.

The target may not always be to minimize the MSE alone but to combine it with smoothing and regularization in order to be able to cope with the cases where there is no correlation between the mono and the side signal.

Informal listening tests reveal that coding artifacts introduced by ICP filtering are perceived as more annoying than temporary reduction in stereo width. In accordance with an exemplary embodiment, the stereo width, i.e. the side signal energy, is therefore intentionally reduced whenever a problematic frame is encountered. In the worst-case scenario, i.e. no ICP filtering at all, the resulting stereo signal is reduced to pure mono. On the other hand, if the frame is not problematic at all, the signal energy does not have to be reduced.

It is possible to calculate the expected filtering performance such as expected prediction gain from the covariance matrix R and the correlation vector r, without having to perform the actual filtering. This is preferably done by a control system as previously described. It has been found that coding artifacts are mainly present in the reconstructed side signal when the anticipated prediction gain is low or equivalently when the correlation between the mono and the side signal is low. In an exemplary realization, a frame classification algorithm is constructed, which performs classification based on estimated level of prediction gain. For example, when the prediction gain (or the correlation) falls below a certain threshold, the covariance matrix used to derive the ICP filter can be modified according to:

$$R^* = R + \rho diag(R) \tag{17}$$

The value of the smoothing factor ρ can be made adaptive to facilitate different levels of modification. The modified ICP filter is computed as $h^* = (R^*)^{-1} r$. Evidently, the energy of the ICP filter is reduced, thus reducing the energy of the reconstructed side signal. Other schemes for reducing the introduced estimation errors are also plausible. This provides a smoothing effect since the reduction in signal energy generally reduces the differences between different frames, considering the fact that there may originally be large differences in the predicted signal from frame to frame.

Rapid changes in the ICP filter characteristics between consecutive frames create disturbing aliasing artifacts and instability in the reconstructed stereo image. This comes from the fact that the predictive approach introduces large spectral variations as opposed to a fixed filtering scheme.

Similar effects are also present in BCC when spectral components of neighboring sub-bands are modified differently [10]. To circumvent this problem, BCC uses overlapping windows in both analysis and synthesis.

The use of overlappning windows solves the alising problem for ICP filtering as well. However, the use of overlapping windows in BCC is not representative of signal-adaptive filter smoothing since there will be a "fixed" smoothing effect and energy reduction for all considered frames irrespective of whether such as reduction is really needed. This results in a rather large performance reduction.

In an exemplary embodiment, a modified cost function is suggested. It is defined as:

$$\begin{aligned} \xi(h_t, h_{t-1}) &= MSE(h_t) + \psi(h_t, h_{t-1}) \\ &= MSE(h_t) + \mu(h_t - h_{t-1})^T R(h_t - h_{t-1}) \end{aligned} \tag{18}$$

where $h_t$ and $h_{t-1}$ are the ICP filters at frame t and (t−1) respectively. Calculating the partial derivative of (18) and setting it to zero yields the new smoothed ICP filter:

$$h_t^*(\mu) = \frac{1}{1+\mu} h_t + \frac{\mu}{1+\mu} h_{t-1} \tag{19}$$

The smoothing factor μ determines the contribution of the previous ICP filter, thereby controlling the level of smoothing. The proposed filter smoothing effectively removes coding artifacts and stabilizes the stereo image. The problem of stereo image width reduction due to smoothing can be alleviated by making the smoothing factor signal-adaptive, and dependent on the filter performance. A large smoothing factor is preferably used when the prediction gain of the previous filter applied to the current frame is high. However, if the previous filter leads to deterioration in the prediction gain, then the smoothing factor may be gradually decreased.

As the skilled person realizes, smoothing information such as the smoothing factors described above can be sent to the decoding side, and the signal-adaptive filter smoothing can equivalently be performed on the decoding side rather than on the encoding side.

The embodiments described above are merely given as examples, and it should be understood that the claims are not limited thereto. Further modifications, changes and improvements which retain the basic underlying principles disclosed are within the scope of the claims.

REFERENCES

[1] U.S. Pat. No. 5,285,498 by Johnston.
[2] European Patent No. 0,497,413 by Veldhuis et al.
[3] C. Faller et al., "Binaural cue coding applied to stereo and multi-channel audio compression", 112th *AES convention*, May 2002, Munich, Germany.

[4] U.S. Pat. No. 5,434,948 by Holt et al.

[5] S—S. Kuo, J. D. Johnston, "A study why cross channel prediction is not applicable to perceptual audio coding", *IEEE Signal Processing Lett.*, vol. 8, pp. 245-247.

[6] B. Edler, C. Faller and G. Schuller, "Perceptual audio coding using a time-varying linear pre- and post-filter", in *AES Convention*, Los Angeles, Calif., September 2000.

[7] Bernd Edler and Gerald Schuller, "Audio coding using a psychoacoustical pre- and post-filter", *ICASSP*-2000 *Conference Record,* 2000.

[8] Dieter Bauer and Dieter Seitzer, "Statistical properties of high-quality stereo signals in the time domain", *IEEE International Conf. on Acoustics, Speech, and Signal Processing*, vol. 3, pp. 2045-2048, May 1989.

[9] Gene H. Golub and Charles F. van Loan, "*Matrix Computations", second edition*, chapter 4, pages 137-138, The John Hopkins University Press, 1989.

[10] C. Faller and F. Baumgarte, "Binaural cue coding—Part I: Psychoacoustic fundamentals and design principles", *IEEE Trans. Speech Audio Processing*, vol. 11, pp. 509-519, November 2003.

The invention claimed is:

1. A method of encoding a multi-channel audio signal comprising the steps of:

encoding a first signal representation of at least one of said multiple channels in a first encoding process;

encoding a second signal representation of at least one of said multiple channels in a second filter-based encoding process;

performing signal-adaptive filter smoothing for a filter in said second encoding process to handle changes in the filter characteristics over time;

estimating expected performance of at least one of said first encoding process and said second encoding process based on characteristics of the multi-channel audio signal; and adapting the filter smoothing in dependence on the estimated performance, wherein said second encoding process includes inter-channel prediction for prediction of said second signal representation based on the first signal representation and the second signal representation, and said filter smoothing is performed based on estimated performance of said second encoding process.

2. The encoding method of claim 1, wherein said step of performing signal-adaptive filter smoothing for a filter in said second encoding process to handle changes in the filter characteristics over time comprises the step of performing signal-adaptive filter smoothing for a filter in said second encoding process to handle changes in the filter characteristics between consecutive frames.

3. The encoding method of claim 1 or 2, wherein said step of estimating expected performance of at least one of said first encoding process and said second encoding process is performed based on inter-channel correlation characteristics of said multi-channel audio signal.

4. The encoding method of claim 1 or 2, wherein expected performance of a filter of said second encoding process is estimated based on characteristics of the multi-channel audio signal, and said filter smoothing is adapted in dependence on the estimated filter performance.

5. The encoding method of claim 4, wherein said filter smoothing is performed by modifying the filter of said second encoding process in dependence on the estimated filter performance.

6. The encoding method of claim 5, wherein the filter is modified by means of a smoothing factor, which is adapted in dependence on the estimated filter performance.

7. The encoding method of claim 5, wherein said filter smoothing is performed by reducing the energy of the filter of said second encoding process in dependence on the estimated filter performance.

8. The encoding method of claim 1, wherein said performance is representative of prediction gain of said inter-channel prediction.

9. An apparatus for encoding a multi-channel audio signal comprising:

a first encoder for encoding a first signal representation of at least one of said multiple channels in a first encoding process;

a second, filter-based encoder for encoding a second signal representation of at least one of said multiple channels in a second encoding process and configured to perform signal-adaptive filter smoothing for a filter in said second filter-based encoder to handle changes in the filter characteristics over time;

electronic circuitry configured to estimate expected performance of at least one of said first encoding process and said second encoding process based on characteristics of the multi-channel audio signal and to adapt the filter smoothing in dependence on the estimated performance, wherein said second filter-based encoder includes an adaptive inter-channel prediction filter for prediction of said second signal representation based on the first signal representation and the second signal representation, and said second filter-based encoder is configured to perform said filter smoothing for said filter based on estimated performance of said second encoder.

10. The encoding apparatus of claim 9, wherein said second filter-based encoder is configured to perform said signal-adaptive filter smoothing to handle changes in the filter characteristics between consecutive frames.

11. The encoding apparatus of claim 9 or 10, wherein said electronic circuitry is configured to estimate expected performance of at least one of said first encoding process and said second encoding process based on inter-channel correlation characteristics of said multi-channel audio signal.

12. The encoding apparatus of claim 9 or 10, wherein said electronic circuitry is configured to estimate expected performance of said filter of said second encoding process based on characteristics of the multi-channel audio signal and to adapt the filter smoothing in dependence on the estimated filter performance.

13. The encoding apparatus of claim 12, wherein said electronic circuitry is configured to modify the filter of said second encoding process in dependence on the estimated filter performance.

14. The encoding apparatus of claim 13, wherein said electronic circuitry is configured to adapt a smoothing factor in dependence on the estimated filter performance and modify the filter based on the smoothing factor.

15. The encoding apparatus of claim 13, wherein said electronic circuitry is configured to reduce the energy of the filter of said second encoding process in dependence on the estimated filter performance.

16. The encoding apparatus of claim 10, wherein said second filter-based encoder is configured to perform said filter smoothing based on prediction gain of said inter-channel prediction filter.

17. A method of decoding an encoded multi-channel audio signal comprising the steps of:

decoding, in response to first signal reconstruction data, an encoded first signal representation of at least one of said multiple channels in a first decoding process;

decoding, in response to second signal reconstruction data, an encoded second signal representation of at least one of said multiple channels in a second decoding process;

receiving information representative of signal-adaptive filter smoothing from an encoding side, wherein said information representative of signal-adaptive filter smoothing comprises information representative of performance of an encoding process including inter-channel prediction on the encoding side estimated based on characteristics of the multi-channel audio signal; and performing, based on said information representative of the performance of an encoding process including inter-channel prediction on the encoding side, signal-adaptive filter smoothing in said second decoding process.

18. The method of claim 17, wherein said signal-adaptive information comprises a smoothing factor that depends on estimated performance of an encoding process on the encoding side.

19. An apparatus for decoding an encoded multi-channel audio signal comprising:

decoding circuitry configured to decode, in response to first signal reconstruction data, an encoded first signal representation of at least one of said multiple channels in a first decoding process and to decode, in response to second signal reconstruction data, an encoded second signal representation of at least one of said multiple channels in a second decoding process;

receiving circuitry configured to receive information representative of signal-adaptive filter smoothing from a corresponding encoding side, wherein said information representative of signal-adaptive filter smoothing comprises information representative of performance of an encoding process including inter-channel prediction on the encoding side estimated based on characteristics of the multi-channel audio signal; and filter smoothing circuitry configured to perform, based on said information representative of the performance of an encoding process including inter-channel prediction on the encoding side, signal-adaptive filter smoothing in said second decoding process.

20. The apparatus of claim 19, wherein said signal-adaptive information comprises a smoothing factor that depends on estimated performance of an encoding process on the encoding side.

21. An audio transmission system comprising at least one of:

a) an apparatus for encoding a multi-channel audio signal comprising:

a first encoder for encoding a first signal representation of at least one of said multiple channels in a first encoding process;

a second, filter-based encoder for encoding a second signal representation of at least one of said multiple channels in a second encoding process;

means for performing signal-adaptive filter smoothing for a filter in said second filter-based encoder to handle changes in the filter characteristics over time;

means for estimating expected performance of at least one of said first encoding process and said second encoding process based on characteristics of the multi-channel audio signal; and means for adapting the filter smoothing in dependence on the estimated performance, wherein said second filter-based encoder includes an adaptive inter-channel prediction filter for prediction of said second signal representation based on the first signal representation and the second signal representation, and said means for performing signal-adaptive filter smoothing for a filter in said second filter-based encoder is configured to perform said filter smoothing for said filter based on estimated performance of said second encoder; and b) an apparatus for decoding an encoded multi-channel audio signal comprising:

means for decoding, in response to first signal reconstruction data, an encoded first signal representation of at least one of said multiple channels in a first decoding process;

means for decoding, in response to second signal reconstruction data, an encoded second signal representation of at least one of said multiple channels in a second decoding process;

means for receiving information representative of signal-adaptive filter smoothing from said apparatus for encoding, wherein said information representative of signal-adaptive filter smoothing comprises information representative of performance of said second encoding process estimated based on characteristics of the multi-channel audio signal; and means for performing, based on said information representative of performance of said second encoding process, signal-adaptive filter smoothing in said second decoding process.

* * * * *